US006499269B1

(12) United States Patent
Beutler

(10) Patent No.: US 6,499,269 B1
(45) Date of Patent: Dec. 31, 2002

(54) METHOD OF MAKING A WINDOW LEDGE

(76) Inventor: Theo S. Beutler, 3933 W. Yucca St., Phoenix, AZ (US) 85029

( * ) Notice: Subject to any disclaimer, the term of this patent is extended or adjusted under 35 U.S.C. 154(b) by 64 days.

(21) Appl. No.: 09/722,198

(22) Filed: Nov. 27, 2000

(51) Int. Cl.[7] ..... E06B 1/70

(52) U.S. Cl. ..... 52/745.19; 52/211; 144/345; 144/353

(58) Field of Search ..... 52/745.19, 745.2, 52/36.4, 204.5, 211, 212, 213; 144/345, 353

(56) References Cited

U.S. PATENT DOCUMENTS 5,220,756 A * 6/1993 Hauser ..... 52/36.4
5,865,929 A * 2/1999 Sing ..... 156/264

* cited by examiner

*Primary Examiner*—Carl D. Friedman
*Assistant Examiner*—Naoko Slack
(74) *Attorney, Agent, or Firm*—H. Gordon Shields

(57) ABSTRACT

The prefabrication of a window ledge is described in sequential steps. The method of prefabricating a window ledge includes preparing two portions, a top portion and a bottom portion. The bottom portion is appropriately profiled in a block, while the top portion is appropriately cut to provide a rounded front edge. After the bottom block has been appropriately cut to provide the desired profile, and a determination of the width of the window in which the window ledge will be installed has been made, the two portions are appropriately cut to size, with the bottom portion having its ends cut to provide the same profile as the front side and the two portions are appropriately secured together, ready for finish coating/painting and installation at the appropriate window frame location.

13 Claims, 1 Drawing Sheet

METHOD OF MAKING A WINDOW LEDGE

BACKGROUND OF THE INVENTION

1. Field of the Invention

This invention relates to window ledges and, more particularly, to the mass production or fabrication of window ledges.

2. Description of the Prior Art

Window ledges of the prior art have typically been made on site. The window ledges include a flat top board and crown molding is typically used for the bottom portion and for the side return portions. Since they are fabricated at the site, they are cut to fit as required. This results in a relatively expensive and time consuming process.

The method of the present invention allows window ledge elements to be fabricated at a shop, remote from the installation location and at the fabrication site the elements are cut to fit a window on which a window ledge is to be installed.

SUMMARY OF THE INVENTION

The invention described and claimed herein comprises a method of prefabricating a window ledge. The window ledge is fabricated in essentially two portions, a top portion and a bottom portion. The top portion is formed in any convenient length with what will become the front edge appropriately rounded and the back or rear edge is generally perpendicular to the top and bottom surfaces. The top and bottom surfaces are, of course, parallel to each other.

A block that will become the lower portion is shaped on four sides. The profile of the bottom shape is predetermined and an appropriate cutter blade is prepared with the desired profile. The block is run through an appropriate cutting tool so that four sides have the same profile. The block is then cut in half to provide two blocks, each of which includes a flat back portion which will be disposed against a wall and the profile front portion. The top of the block, and accordingly of the two smaller blocks is generally flat and will be appropriately secured to the bottom of the top board.

After the top and bottom portions are secured together, they may be appropriately prefinished with a primer coat. If desired, a painted coat may be applied over the primer coat. In the alternative, the completed window ledge may be stained or left unfinished, with an appropriate finish applied at the site of installation.

At the site, the top portion is appropriately cut to fit the window frame and adjacent wall, and the window ledge is then secured in place.

Among the objects of the present invention are the following:

To provide a new and useful method of making a window ledge;

To provide a new and useful method of prefabricating window ledge elements;

To provide a new and useful method of fabricating a window ledge at a site remote from the location in which the window ledge will be installed;

To provide a new and useful method of fabricating the window ledge from a generally flat board and from a block;

To provide a new and useful window ledge made of wood;

To provide a new and useful window ledge made of wood products;

to provide a new and useful window ledge made from a single block element;

To provide a new and useful window ledge made of a top board and a block shaped with a desired profile; and To provide a new and useful method of mass producing window ledge elements.

DESCRIPTION OF THE PREFERRED EMBODIMENT

Figure 1:
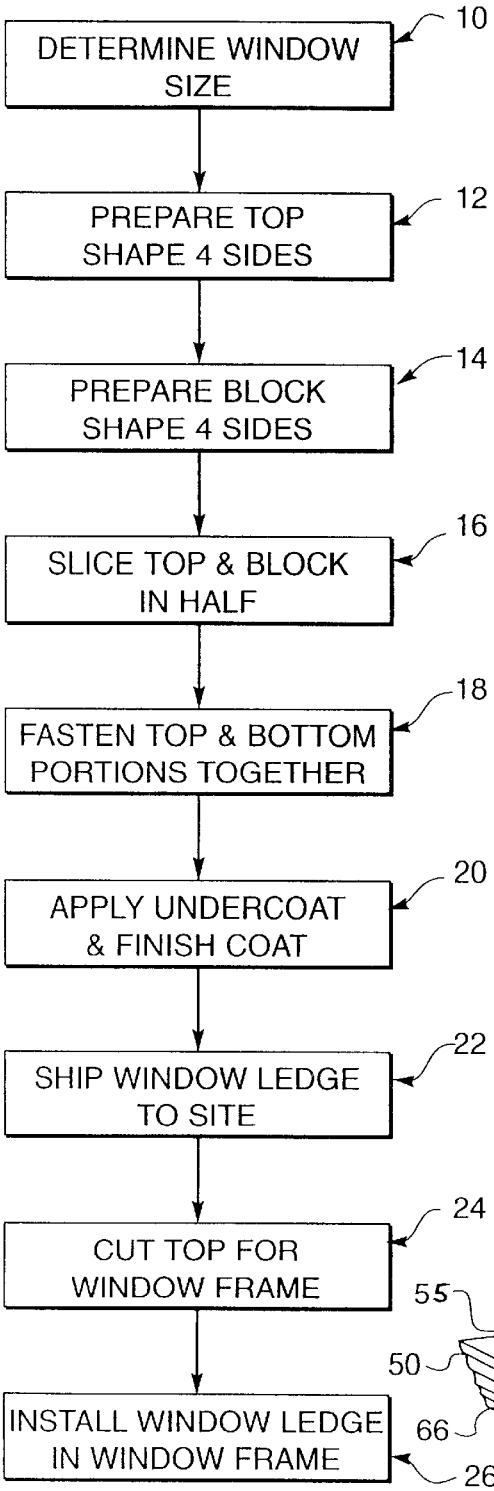
FIG. 1 is a block diagram illustrating the method of the present invention.

FIG. 1 is a block diagram illustrating the steps involved in the method of the present invention for making a window ledge. The mass production of a window ledge is sequentially set forth in the steps of FIG. 1.

For mass producing a window ledge, it must first be determined the size of the window in which the window ledge will be secured. Typically, windows, in two feet, four feet, and six feet widths. There are, of course, custom windows which may vary from the two feet, four feet, and six feet lengths. However, most common windows are that size. Accordingly, the first step indicated by block 10 is to determine the size of the window frame for which window ledges will be mass produced.

Figure 2:
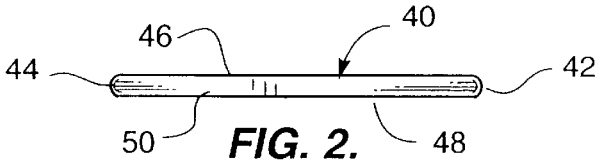
FIG. 2 is an end view of one of the elements involved in the present invention.

After the window size has been determined, block 12 indicates that the top for the window ledge must be prepared. This is accomplished by selecting a top of the appropriate length and a predetermined. Width. The purpose of the predetermined width is to enable the finished top to be cut in half, thus providing two window ledge tops. The window ledge top may be made of wood or wood product type materials, such as MDF, or the like. To prepare a window ledge top, four sides are appropriately shaped. This is indicated in FIG. 2. FIG. 2 is an end view of a top 40 showing a pair of rounded sides 42 and 44, a rounded end 50, and a relatively flat top surface 46 and a relatively flat bottom surface 48. The top and bottom surfaces 46 and 48, respectively, are generally parallel to each other.

The next step in the mass production of a window ledge is indicated by block 14 by preparing a block and shaping its four sides. The block comprises the bottom portion of a finished window ledge. The block, like the top 40, may be made of wood or a wood product and again the block is selected as double the size of a desired window ledge bottom. This enables the block to be cut in half.

Figure 4:
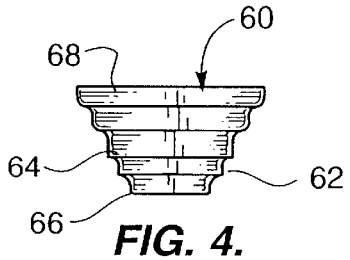
FIG. 4 is an end view of another element of the present invention.

A shaped block is indicated in FIG. 4, which comprises an end view of a block 60 after it has been shaped. The block 60 includes a pair of shaped sides 62 and 64 and a pair of shaped ends, such as the end 66. The block 60 also includes a relatively flat top surface 68. The top surface 68 will be appropriately secured to the bottom surface 48 of a top 40 in the construction of a window ledge.

Figure 3:
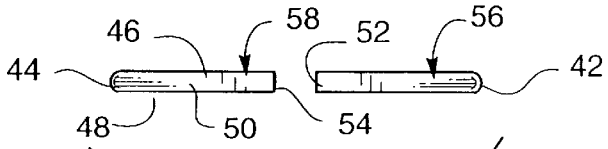
FIG. 3 is an end view sequentially following FIG. 2.

Block 16 of FIG. 1 indicates that both the top and the block are sliced in half. FIG. 3 illustrates the result of slicing a top in half. The top 40 is now divided into two tops, a top 56 and a top 58. The top 56 includes the rounded side 42 and a flat side 52. The top 58 includes the rounded side 44 and a flat side 54. The flat sides 52 and 54 will, of course, be disposed in the window frame, with the rounded sides 42 and 44 extending outwardly.

Figure 5:
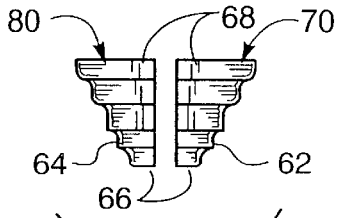
FIG. 5 is an end view sequentially following FIG. 4.

FIG. 5 discloses the block 60 after it has been cut in half to define or provide two bottom portions 70 and 80 which will be appropriately secured to the top portions 56 and 58, respectively, to provide two window ledges.

The lower portions 70 and 80 include the generally flat upper surfaces 68, and the end shaped surfaces 66. The lower portion 70 includes the sides 62, while the lower portion includes the shaped side 64.

The next step in the production of a window ledge is indicated in block 18 as securing a top and a bottom portion together. This is typically accomplished by an adhesive or glue component.

Figure 6:
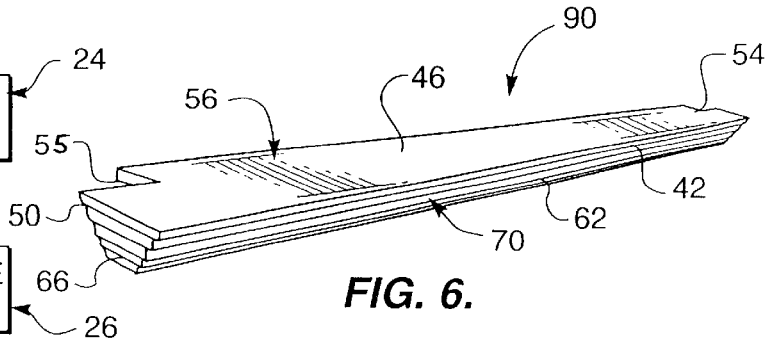
FIG. 6 is a perspective view of a completed window ledge of the present invention.

FIG. 6 is a perspective view of a completed window ledge, showing the top portion 56 secured to a lower portion 70. The top surface 46 is shown, with the rounded side 42 shown, as well as the rounded end 50. With respect to the lower portion 70, the shaped side 62 is shown along with the shaped end 66.

After the top and bottom portions have been secured together, an undercoat and a finish coat may be applied, if desired. If the window ledge is to be shipped unfinished, then the step indicated by block 20 may be omitted. Similarly, if a stain is to be applied, as opposed to an undercoat and a finish coat, the stain would be applied in place of block 20.

Sequentially, the next step is indicated by block 22. Block 22 indicates that the window ledge is then shipped to the site of installation. At the site of installation, the top will be cut to fit a specific window frame. This is indicated by block 24. Even though windows may be "standard" in dimensions, curvatures of walls or slight differences in the finished window frame require that the upper or top of the window ledge must be appropriately cut and scribed to fit the window frame. This is typically accomplished, of course, at the site, and results in the cutting of at least two notches in the top. In FIG. 6, a pair of notches 54 and 55 are shown at opposite ends of the window ledge 90. After the notches 54 and 55 have been cut in the top 56, the window ledge is installed in the window frame.

Typically, the shaping of both the top and the block, indicated in blocks 12 and 14 of FIG. 1, are accomplished by use of a desired cutter blade which has the profile desired by the manufacturer or the end user. Obviously, the profile of a window ledge may be custom made by having a cutter blade with a desired profile on it.

As indicated above, both the top portion and bottom portions of the window ledge elements may be made out of wood or wood products. If an undercoat and a finish coat of paint is to be applied, whether wood or wood product is to be used is relatively immaterial. However, if a stain is to be applied, then the lower portion will be fabricated from a solid block of wood and the top portion may be fabricated of a wood product with a wood laminate on it or it may be made of solid wood material. In manufacturing, the use of solid wood or of a wood product material makes relatively little difference with respect to the end product. The primary difference is, of course, the desired appearance of the end product, whether a stain is to be used or whether a paint coat is to be used.

While the steps have been indicated sequentially in FIG. 1, it will be understood that the use of a computer numerical control machine (CNC) may result in the combination of steps in that the entire window ledge may be cut from one piece of material instead of having to prepare the top portion and the bottom portion separately. Still, the overall window ledge manufactured by use of a CNC machine will still be cut in half to provide two window ledges from one block of material.

While the preferred method of making a window ledge discussed above includes the essentially double fabrication of both the top portion and the bottom portion of a window ledge, and then cutting the double portions in half to produce two window ledges from the doubled portions, it may be desirable under some circumstances to fabricate a window ledge by making the portions singly. This "single" fabrication, as opposed to the "double" fabrication, may be most appropriate when a window ledge is fabricated for a custom dimensioned window frame, a window frame that is other than the "standard" widths of two feet, four feet, and six feet, as discussed above. Of course, if there are two custom length window frames, then the double fabrication, as discussed, may be employed.

However, if the single fabrication of a window ledge is to be accomplished, then the steps outlined in blocks 12, 14, and 16 may be in the singular rather than in the plural, all within the purview of the present invention.

Moreover, it will be noted that the sanding of the top and bottom elements has been omitted. Sanding may take place up to several times throughout the manufacturing process, depending on any of several variables, such as the type of material being used, the desired profile, etc. Such will be readily understood by people who work with wood or wood products.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. A method of prefabricating a window ledge comprising the steps of:

determining a window size;

preparing a top portion by shaping four sides;

cutting the top portion in half longitudinally to provide two top portions;

preparing a bottom portion by providing a block and shaping at least a front side and a pair of ends on the block; and fastening one of the top portions and the bottom portion together to define a window ledge.

2. The method of claim 1 in which the step of preparing a bottom portion includes the steps of shaping a fourth side and cutting the block in half longitudinally to provide two lower portions.

3. The method of claim 1 which includes the further step of painting the window ledge.

4. The method of claim 1 which includes the further step of providing a piece of wood for the top portion.

5. The method of claim 1 which includes the further step of providing a piece of wood product for the top portion.

6. The method of claim 1 which includes the further step of providing a block of wood for the bottom portion.

7. The method of claim 1 which includes the further step of providing a block of wood product for the bottom portion.

8. A method of prefabricating a window ledge comprising the steps of:

providing a top portion;

shaping four sides of the top portion;

cutting the shaped top portion in half longitudinally to provide two top portions;

providing a block for a bottom portion;

shaping four sides of the block to provide a desired profile for the bottom portion;

cutting the shaped block longitudinally in half to provide two bottom portions;

securing one of the top portions to one of the bottom portions to provide a window ledge.

9. The method of claim 8 which includes the further step of painting the window ledge.

10. The method of claim 8 in which the step of providing a top portion includes the step of providing a piece of wood.

11. The method of claim 8 in which the step of providing a top portion includes the step of providing a piece of wood product.

12. The method of claim 8 in which the step of providing a block includes the step of providing a block of wood.

13. The method of claim 8 in which the step of providing a block includes the step of providing a block of wood product.

* * * * *